US011173531B2

(12) United States Patent
Armbruster et al.

(10) Patent No.: US 11,173,531 B2
(45) Date of Patent: Nov. 16, 2021

(54) ROLLER LEVELER WITH UPPER AND LOWER LEVELING ROLLERS AND METHOD FOR THE SIMPLE AND RAPID INSPECTION, MAINTENANCE, AND SERVICING OF THE UPPER LEVELING ROLLERS OF A ROLLER LEVELER

(71) Applicant: ARKU Maschinenbau GmbH, Baden-Baden (DE)

(72) Inventors: Christian Armbruster, Buehlertal (DE); Christian Hartmann, Waghaeusel (DE)

(73) Assignee: ARKU MASCHINENBAU GmbH

( * ) Notice: Subject to any disclaimer, the term of this patent is extended or adjusted under 35 U.S.C. 154(b) by 53 days.

(21) Appl. No.: 16/303,381

(22) PCT Filed: Apr. 3, 2017

(86) PCT No.: PCT/EP2017/057858
§ 371 (c)(1),
(2) Date: Feb. 6, 2020

(87) PCT Pub. No.: WO2017/202532
PCT Pub. Date: Nov. 30, 2017

(65) Prior Publication Data

US 2020/0164421 A1 May 28, 2020

(30) Foreign Application Priority Data

May 23, 2016 (EP) ..... 16170840

(51) Int. Cl.
*B21D 1/02* (2006.01)
*B21D 37/14* (2006.01)

(52) U.S. Cl.
CPC ..... *B21D 1/02* (2013.01); *B21D 37/147* (2013.01)

(58) Field of Classification Search
CPC .. B21D 1/02; B21D 37/147; B21B 2015/0071
(Continued)

(56) References Cited

U.S. PATENT DOCUMENTS 4,313,322 A * 2/1982 Malinowski ..... B21D 1/02 72/164
4,368,633 A * 1/1983 Nogota ..... B21D 5/08 72/238

(Continued)

FOREIGN PATENT DOCUMENTS

DE 21 31 739 5/1972
DE 10 2007 046 138 B3 6/2009
EP 2 631 019 A1 8/2013

*Primary Examiner* — Adam J Eiseman
*Assistant Examiner* — Mohammed S. Alawadi
(74) *Attorney, Agent, or Firm* — Jansson Munger McKinley & Kirby Ltd.

(57) ABSTRACT

A roller leveler and related method for leveling stock which includes an upper roller frame with an upper leveling unit, and a lower roller frame which has a machine bed with a lower leveling unit. The upper roller frame can be moved upward and downward relative to the lower roller frame by hydraulic drives. The upper leveling unit includes a plurality of upper leveling rollers and the lower leveling unit has a plurality of lower leveling rollers. The upper leveling rollers are supported with upper bearing plates and the lower leveling rollers are supported with lower bearing plates. At least several of the upper and lower leveling rollers are connected at one end to drive shafts of a drive device. A frame is moveable into and out of the roller leveler.

16 Claims, 9 Drawing Sheets

(58) Field of Classification Search
USPC ..... 72/160, 163–165
See application file for complete search history.

(56) References Cited

U.S. PATENT DOCUMENTS 4,454,738 A * 6/1984 Buta ..... B21D 1/02 72/10.1
4,635,458 A * 1/1987 Bradlee ..... B21D 1/02 72/163
4,726,108 A * 2/1988 Poloni ..... B21B 31/08 29/281.1
5,189,896 A * 3/1993 Melzer ..... B21D 1/02 72/11.3
5,392,627 A * 2/1995 Benz ..... B21D 1/02 72/163
5,660,068 A * 8/1997 Yamamoto ..... B21D 3/05 72/164
5,758,533 A * 6/1998 Quehen ..... B21D 1/02 72/163
6,318,141 B1 * 11/2001 Tokunaga ..... B21D 1/02 72/164
6,354,127 B1 * 3/2002 Rossini ..... B21D 3/05 72/164
6,769,279 B1 * 8/2004 Bergman ..... B21D 1/02 72/11.4
6,843,091 B2 * 1/2005 Hartung ..... B21D 3/05 72/164
10,603,704 B2 * 3/2020 Willems ..... B21D 37/147
2002/0046589 A1 * 4/2002 Rohleder ..... B21D 1/05 72/164
2007/0044531 A1 * 3/2007 Liefer ..... B21D 1/02 72/160
2007/0055393 A1 * 3/2007 Farnik ..... B21D 1/02 700/56
2010/0162784 A1 * 7/2010 Buta ..... B21D 1/02 72/226
2015/0283591 A1 * 10/2015 Mercer ..... B21B 31/12 72/249
2016/0003608 A1 * 1/2016 Lenz ..... G01B 11/005 356/622
2016/0016214 A1 * 1/2016 Nespoli ..... B21D 37/147 72/239
2017/0266792 A1 * 9/2017 Rode ..... F16C 25/06

* cited by examiner

ROLLER LEVELER WITH UPPER AND LOWER LEVELING ROLLERS AND METHOD FOR THE SIMPLE AND RAPID INSPECTION, MAINTENANCE, AND SERVICING OF THE UPPER LEVELING ROLLERS OF A ROLLER LEVELER

CROSS-REFERENCE TO RELATED APPLICATION

The present application is a U.S. national phase entry of pending International Patent Application No. PCT/EP2017/057858, international filing date Apr. 3, 2017, which claims priority to European Patent Application No. EP16,170840.9, filed May 23, 2016, the contents of which are incorporated by reference in their entireties.

FIELD OF THE INVENTION

The present invention relates to a roller leveler for leveling material for stock to be leveled, especially strips and parts of metal, in which the upper leveling rollers can be quickly and easily inspected, maintained, and serviced as well as cleaned.

The present invention also relates to a method for the simple and rapid inspection, maintenance, servicing, and cleaning of especially the upper leveling rollers of a roller leveler.

BACKGROUND OF THE INVENTION

After the production process, the surfaces of rolled materials such as strip steel or rolled plate, especially hot-rolled plate, carry impurities such as scale, which is removed as the stock is being leveled by the back-and-forth bending which it is subjected to by the roller leveler, after which the scale either falls down by gravity or remains stuck to the upper elements of the roller leveler. In other cases, special processing techniques applied to pieces such as welding also generate impurities, which, during the following leveling process, can lead to the accumulation of dirt on the leveling machine and to corresponding wear, especially of the leveling rollers.

Roller levelers usually include an upper roller frame and a lower roller frame, which usually has a machine bed or a base. The frames hold upper and lower leveling units and the upper leveling unit can be moved upwards and downwards relative to the lower leveling unit by a plurality of drives, and it can also be tilted for the purpose of, for example, adjusting the leveling gap. The upper leveling unit usually includes a plurality of upper leveling rollers, and the lower leveling unit usually has a plurality of lower leveling rollers. The upper leveling rollers are supported in upper bearing plates, and the lower leveling rollers are supported in lower bearing plates.

A plurality of upper back-up rollers of the upper leveling unit and a plurality of lower back-up rollers of the lower leveling unit serve to support the upper and lower leveling rollers. The upper and lower back-up rollers are supported in a plurality of back-up roller blocks. The number of back-up rollers depends on the pass-through width of the leveler.

The dirt introduced into the leveler by the material to be leveled can adhere both to the leveling rollers themselves and to the back-up rollers and can thus impair the leveling result. In addition, dirt also increases the amount of wear normally caused by the leveling work.

During the operation of roller levelers, cleaning operations must be carried out at certain intervals; in addition, it is also necessary to conduct inspection, maintenance, and servicing work up to and including the replacement of various components.

The servicing and cleaning of the back-up rollers requires a great deal of time in the prior art patents because the leveler must be partially disassembled and then reassembled. To reduce this period of time, prior art patent DE10,2007/046138 B3 proposes that the leveling rollers be arranged in replaceable cassettes and that these cassettes be fastened to "slider plates," which can be pulled out of the leveler, as a result of which access is gained to the individual replaceable cassette, which can then be removed, inspected, and cleaned as appropriate, or individual parts or the complete unit can be replaced if necessary. This indicates, however, that a great deal of time is required, even when only light cleaning work is to be carried out, for example, which doesn't even call for the removal of the leveling rollers.

Another disadvantage of the prior art is that work of this type on the upper replaceable cassette must be carried out in an overhead manner. That is, the worker must reach up from underneath to the replaceable cassette, which is suspended from the upper slider plate; this is an extremely cumbersome working position from an ergonomic point of view. It is not possible, furthermore, to remove the entire upper replaceable cassette together with the leveling rollers and back-up roller blocks and to replace it quickly. It is to these needs in the industry that the present application is drawn.

SUMMARY OF THE INVENTION

The present invention is based on the premise of creating a roller leveler in which the disadvantages of the prior art are avoided and which makes it possible to inspect, maintain, service, and clean the upper leveling rollers of the roller leveler easily, quickly, and ergonomically.

An advantage and goal of the present invention is to provide a corresponding method for the simple, rapid, and ergonomic inspection, maintenance, servicing, and cleaning of the upper leveling rollers of a roller leveler.

According to the present invention, the upper leveling unit preferably includes a frame on which the bearing plates of the upper leveling rollers and the back-up roller blocks are supported so the frame can be moved out of the roller leveler at least to a considerable extent and moved back in again.

After the frame has been moved out, it is preferable that the upper leveling unit is accessible from above, and the back-up roller blocks can be lifted up and away. Preferably, after the back-up roller blocks have been removed, the leveling rollers are now also accessible from above and can be easily and ergonomically subjected to a visual inspection. This avoids the disadvantage of which the prior art suffers, namely, that an inspection of the leveling rollers from underneath can usually be conducted successfully only with the help of an additional light source, because the slider plate and the back-up roller blocks lying on top create deep shadows.

As a result of the frame structure, considerable savings in material and weight are achieved in comparison to a slider plate. This also reduces the wear on the bearings, because the considerably reduced mass of the upper leveling unit results in a significant decrease in the load exerted on its supporting components.

It is advantageous for the frame to be preferably constructed of at least two longitudinal rails, which are connected to each other at both ends by transverse struts. This creates a stable frame which is also relatively resistant to twisting, but at the same time only a minimal amount of material is required, and its weight is thus, advantageously minimized.

It is also advantageous that because of the low weight of the frame, the frame can be moved almost completely out of the leveling machine and then moved back in again. This is associated with the significant advantage that nearly all of the back-up roller blocks can be lifted upward out of the frame without the need to shift them laterally; only the rear-most back-up roller block, i.e., the one closest to the drive of the leveling rollers, must be moved forward slightly so that it can be removed from the frame.

Alternatively, however, it is also possible to lengthen the frame into the area of the leveler's drive devices to such an extent that is possible to move the back-up roller blocks and thus, also the leveling rollers completely out of the leveler, which speeds up and simplifies the performance of the intended work even more.

In the case of small leveling machines, it is possible in principle that the frame of the upper leveling unit could be moved manually. It is more advantageous, however, especially because it facilitates the automation of the work, for the movement of the frame to be carried out by a drive, preferably by an electric motor. The drive actuates a non-suitable working spindle, which engages with a nut connected to the frame. To move the frame, the working spindle is rotated by the drive, preferably by the electric motor, as a result of which the nut is subjected to a translational movement, which carries the frame along in the corresponding direction, depending on the direction in which the working spindle rotates.

It is also advantageous and preferable to provide a positive, releasable coupling, preferably consisting of a sleeve element and a neck element (also referred to as a "female" and a "male" element), between the drive shafts of the leveling rollers and the driven leveling rollers, the sleeve element is supported in a coupling bearing plate. As a result of this type of coupling, the connection between the drive shafts of the leveling rollers and the driven leveling rollers can be released without the need for any additional interventions, and the connection can also be reestablished upon the inward movement of the frame into the leveler.

In preferred embodiments, the sleeve element can be configured in such a way that it includes, for example, a polygonal internal recess such as an internal hexagonal recess, and the neck element of the leveling roller then includes a corresponding external hexagonal contour. This creates a coupling with a positive connection. The frame of this invention could also include any other type of positive connection.

Because the couplings are in a difficult-to-access and also difficult-to-see position in the leveling machine, it is especially advantageous and preferable for the leveling machine according to the invention to have a system by which it can be determined whether or not the drive of the leveling rollers is effectively coupled to the leveling rollers. According to preferred embodiments of the invention, the sleeve element has a groove, through which a beam, preferably a light beam, can be conducted from a source in a direction transverse to the axes of the leveling rollers to a receiving device. The detection of the light beam by the receiving device establishes that an effective coupling exists between the leveling rollers and the drive shafts.

The source of the light beam, preferably such as a laser beam, can be arranged on one of the two long sides of the leveling unit, and the receiving device can be arranged on the other long side. Alternatively, however, a source and a receiver can be combined into a single unit and arranged on one side, whereas the transmitted beam is reflected back by an appropriate mirror on the other side.

Alternatively, inductive pickups, for example, can be provided, which can determine the correct position of the leveling rollers relative to the drive shafts.

The present invention creates the significant advantage that the back-up roller blocks are supported on the frame in a floating manner. As a result, there is no need for fastening devices for the individual back-up roller blocks, as a result of which the removal and reinstallation of the back-up roller blocks, in contrast to the prior art, can be accomplished without complicated and time-consuming disassembly and refastening work. In addition, it is relatively easy to shift the back-up roller blocks on the frame.

The back-up roller blocks, which support the back-up rollers, are usually so heavy that they cannot be lifted out of the frame by hand. For this reason, a connecting device is preferably provided so that the blocks can be connected to a lifting device such as a gantry crane in a production building; this makes it possible to lift out and replace an individual back-up roller block or several back-up roller blocks simultaneously. The connecting device can be configured as an anchor which can be inserted into the back-up roller block, a magnet, or a suction device operating with negative pressure. As a result, this is a considerable advantage with respect to the technical side of handling in comparison to the prior-art process of allowing the heavy back-up roller blocks to drop down from the slide plate.

An alternative preferred embodiment includes pivotal U-bolts which can be arranged on the top of the back-up roller blocks, which, when in the rest position, are flush with the top surface of the back-up roller block and which can be raised so that they can be connected to the hook of an appropriate lifting device so that the back-up roller blocks can be removed.

Anchors which can be used also include so-called "lifting pins" (for example, as sold by Erwin Halder K G; halderusa.com), which can be inserted into through-holes in the back-up roller blocks.

Another advantage of the leveling machine according to the invention is that both the control of the movement of the frame by which the upper leveling unit is backed out and the control of the coupling mechanism are integrated into the machine control system, therefore, there is no need for additional control devices.

The present invention also includes within its scope a method for the fast, easy, and ergonomic inspection, maintenance, and servicing as well as cleaning of the upper leveling rollers of a roller leveler. The method preferred method includes the following steps: (a) moving the upper leveling unit out of the leveling machine; (b) releasing the fastening of the forward bearing plate; (c) connecting one or more of the upper back-up roller blocks to be lifted out to a lifting device; (d) lifting the one or more upper back-up roller blocks out of the frame and possibly setting it or them down onto a suitable support surface; (e) possibly repeating step (d); (f) inspecting the upper leveling rollers from above and possibly cleaning and/or replacing leveling rollers; (g) reinstalling the upper back-up roller blocks; (h) fastening the forward bearing plate; and (I) moving the upper leveling unit back into the leveling machine and connecting the leveling rollers to their drive device.

According to the method of the invention, an improvement is created by being able to lift an individual back-up roller block upward to give quick access to the leveling rollers from above; in addition, the back-up roller blocks can also be quickly inspected or cleaned or replaced by new back-up roller blocks. Because different leveling rollers are subjected to different degrees of wear, it is possible in particular to detect the amount of wear easily in an especially ergonomic manner from above, especially since the rollers are not in a shadow; the leveling rollers can then be pulled out individually as desired and cleaned or serviced, or new leveling rollers can be easily reinstalled above the retainers. All this can be accomplished with only a few manual operations.

It is also advantage of the present invention that the positive polygonal profiles at the ends of the leveling rollers are brought into engagement with the positive profiles of the coupling elements of the drive device in step (I) in that, under pressure, the coupling elements are rotated, possibly with a back-and-forth rotational movement, until the ends of the leveling rollers engage with the coupling elements. As this is being done, the leveling rollers press on the sleeve elements and shift them along the polygonal profiles of the drive shafts until angular agreement is achieved between the internal profile of the sleeve elements and the external profile of the terminal necks of the leveling rollers. The coupling elements, configured as sleeve elements, are preferably subject to the force of spring devices surrounding the drive shafts, which are put under tension as the as-yet unengaged sleeve elements are being pushed back onto the drive shafts. After the sleeve elements and the neck elements have become engaged, the pretension causes the coupling elements to spring back toward the leveling rollers, which successfully ends the coupling process.

It is also an improvement that a light barrier can be used to verify that all of the leveling rollers are properly coupled, which therefore represents the overall completion of the simple process of installing the leveling unit. After that, the leveling machine can properly perform its leveling task.

BRIEF DESCRIPTION OF THE DRAWINGS

Additional details, features, and advantages of the present invention can be derived from the following description, which refers to the drawings, in which.

DESCRIPTION OF PREFERRED EMBODIMENT

Figure 1:
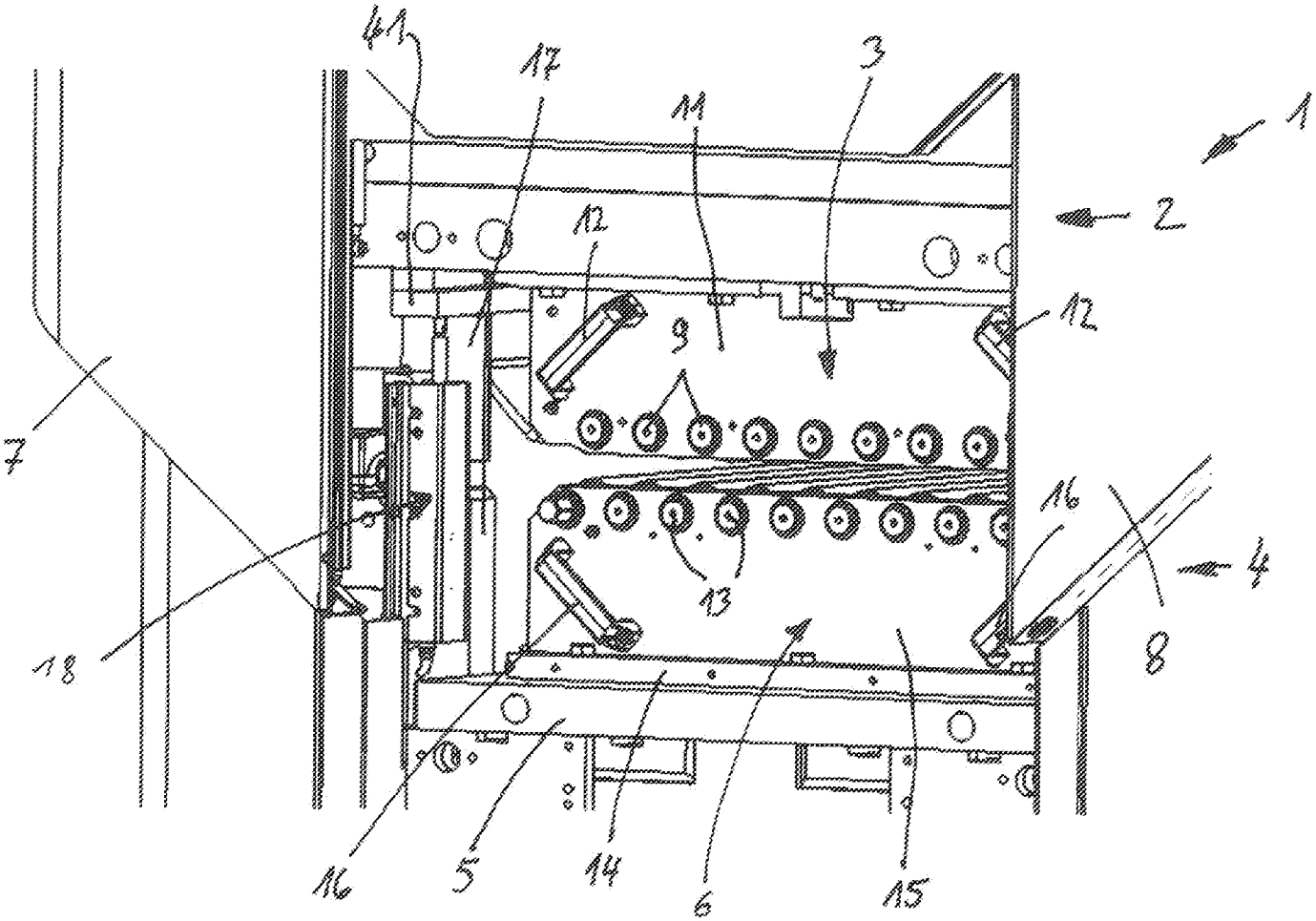
FIG. 1 represents a side view of a roller leveler according to the invention, showing the upper and lower leveling units after the machine cover has been opened.

FIG. 1 shows a perspective view of a roller leveler 1 according to the invention which includes an upper roller frame 2 and a lower roller frame 4; the upper frame has an upper leveling unit 3. The lower roller frame 4 has a machine bed or base 5. A lower leveling unit 6 is arranged on the machine bed 5.

Roller leveler 1 includes a machine cover, with a left cover section 7 and a right cover section 8, both of which are shown in the open position and which give access to roller frames 2 and 4.

Roller leveler 1 has a hydraulic drive in each of the four corners of the roller leveler to move upper roller assembly 2 relative to lower the roller assembly 4. The hydraulic drive at the front left in FIG. 1 is shown in only a highly schematic manner, i.e., without the hydraulic cylinder but with its mounting frame 17. This drive is not described in any further detail.

Upper leveling unit 3 includes upper leveling rollers 9, which are supported in upper bearing plates 11; the plate in front can be seen in FIG. 1. Loop-like handles 12 are provided at the top front so that bearing plate 11 can be gripped.

Lower leveling unit 6 has lower leveling rollers 13, which are supported in lower bearing plates 15; this plate can be seen in FIG. 1. Loop-like handles 16 are arranged on the front side of lower bearing plate 15 so that it can be handled.

As can be seen in FIG. 1, roller leveler 1 is in a raised state; that is, upper roller assembly 2 is arranged a certain distance away from roller assembly 4. This state corresponds to the resting position of roller leveler 1.

So that the distance or the gap between the upper and lower leveling units can be detected, a distance-measuring system 18 is provided, which also detects the leveling gap during the operation of leveling machine 1.

Lower leveling unit 6 includes a mounting plate 14, on which lower bearing plates 15 are supported. Mounting plate 14 can be moved out of leveling machine 1, as a result of which lower leveling rollers 13 are made accessible.

Upper leveling unit 3 has a framework structure, which will be described in more detail with reference to FIG. 4. A longitudinal rail 41 of this structure, which is configured with an L-shaped cross section, is shown in FIG. 1.

Figure 2:
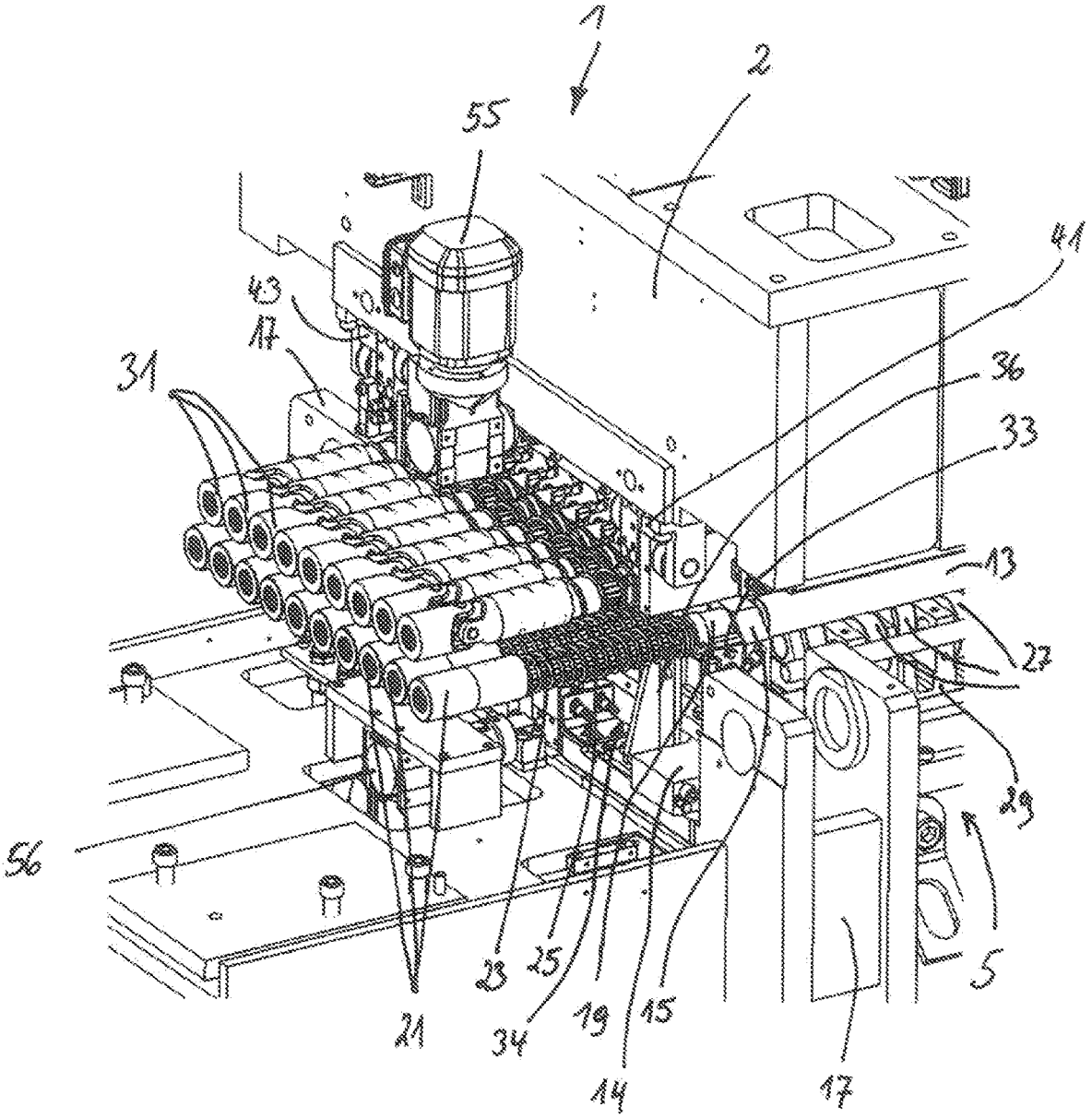
FIG. 2 shows a perspective view of the rear of the roller leveler according to the invention with upper drive shafts for the upper leveling unit and lower drive shafts for the lower leveling unit.

Reference will now be made to FIG. 2. FIG. 2 shows a perspective view, at angle from above, of the rear area of roller leveler 1 in schematic fashion.

As can be seen, lower leveling rollers 13, which are supported in lower bearing plate 15, are connected to positive, releasable couplings in the form of sleeve elements 19. FIG. 2 shows the engaged position. Sleeve elements 19 are arranged on the forward end of the lower drive shafts 21, which are configured as rigid shafts and which include a section with a polygonal profile 23.

At the end facing the leveling rollers, sleeve elements 19 include an internal contour with a polygonal profile, in particular a hexagonal interior profile, which cooperates with a corresponding external profile of the neck-like projections of leveling rollers 13; the two profiles are engaged during the operation of the machine. At the end facing drive shaft 21, sleeve elements 19 have a corresponding internal profile, as a result of which they can slide along polygonal profile 23 in the longitudinal direction. A spring device in the form of a helical spring 25 is arranged around polygonal profile 23; this spring pushes on sleeve element 19 and, when sleeve element 19 lines up with the neck-like projection of leveling roller 13, the spring pushes sleeve element 19 onto the neck-like projection. The sleeve elements are supported in a lower coupling bearing plate 33 with freedom to rotate and to move longitudinally.

As can also be seen in FIG. 2, lower leveling rollers 13 are supported on lower back-up rollers 27, which for their own part are supported in lower back-up roller blocks 29. Lower back-up roller blocks 29 rest on mounting plate 14 in a floating manner; that is, they are held only between two longitudinal rails and have no independent fastening of their own; they are not, for example, screwed down. Accordingly, lower back-up roller blocks 29 can be quickly and easily removed from mounting plate 14.

Figure 9:
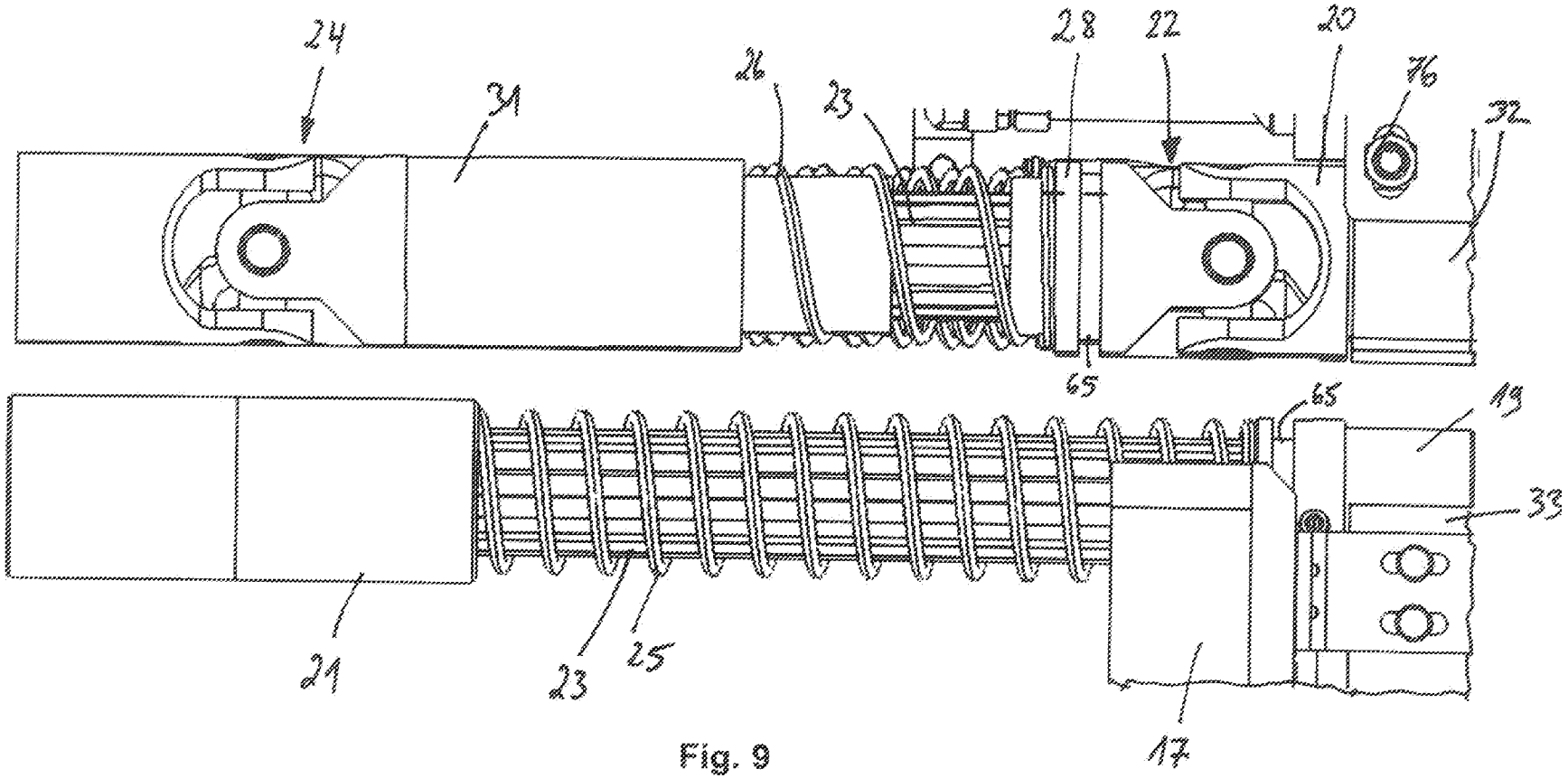
FIG. 9 shows an enlarged side view of an upper and a lower drive shaft of the leveling machine.
Figure 10:
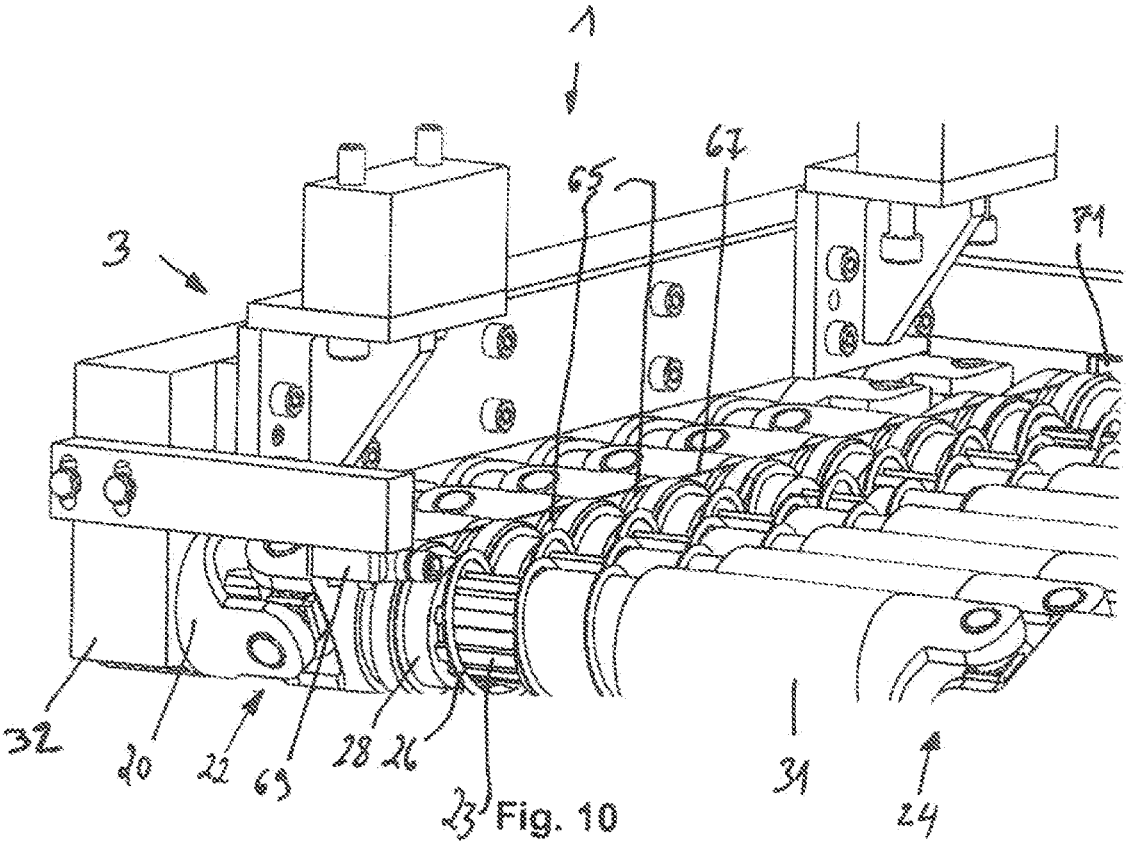
FIG. 10 shows a side view, in perspective and from above, of the upper coupling elements of the upper leveling unit.

Also shown in FIG. 2 is an arrangement of upper drive shafts 31, which are configured as universal shafts 31 and are connected to upper leveling rollers 9 by appropriate coupling elements, as will be described in greater detail further below (FIGS. 9 and 10). Universal shafts 31 include joints known in and of themselves so that the shafts can adjust their orientation during the vertical movement of upper leveling unit 3.

Both lower drive shafts 21 and upper driving universal shafts 31 are connected to a conventional drive device, possibly by an appropriate transfer case, not shown in detail.

Only frame-like mountings 17 of the hydraulic cylinders are shown, so that it is possible to see leveling units 3, 6 and their drive shafts 21, 31.

Mounting plate 14 of lower leveling unit 6 has a recess 34 on each long side in its rear or rearward section; a brace, which is connected to mounting plate 14 at one end and fastened to lower coupling bearing plate 33 at the other end, is located in each of these recesses.

Figure 3:
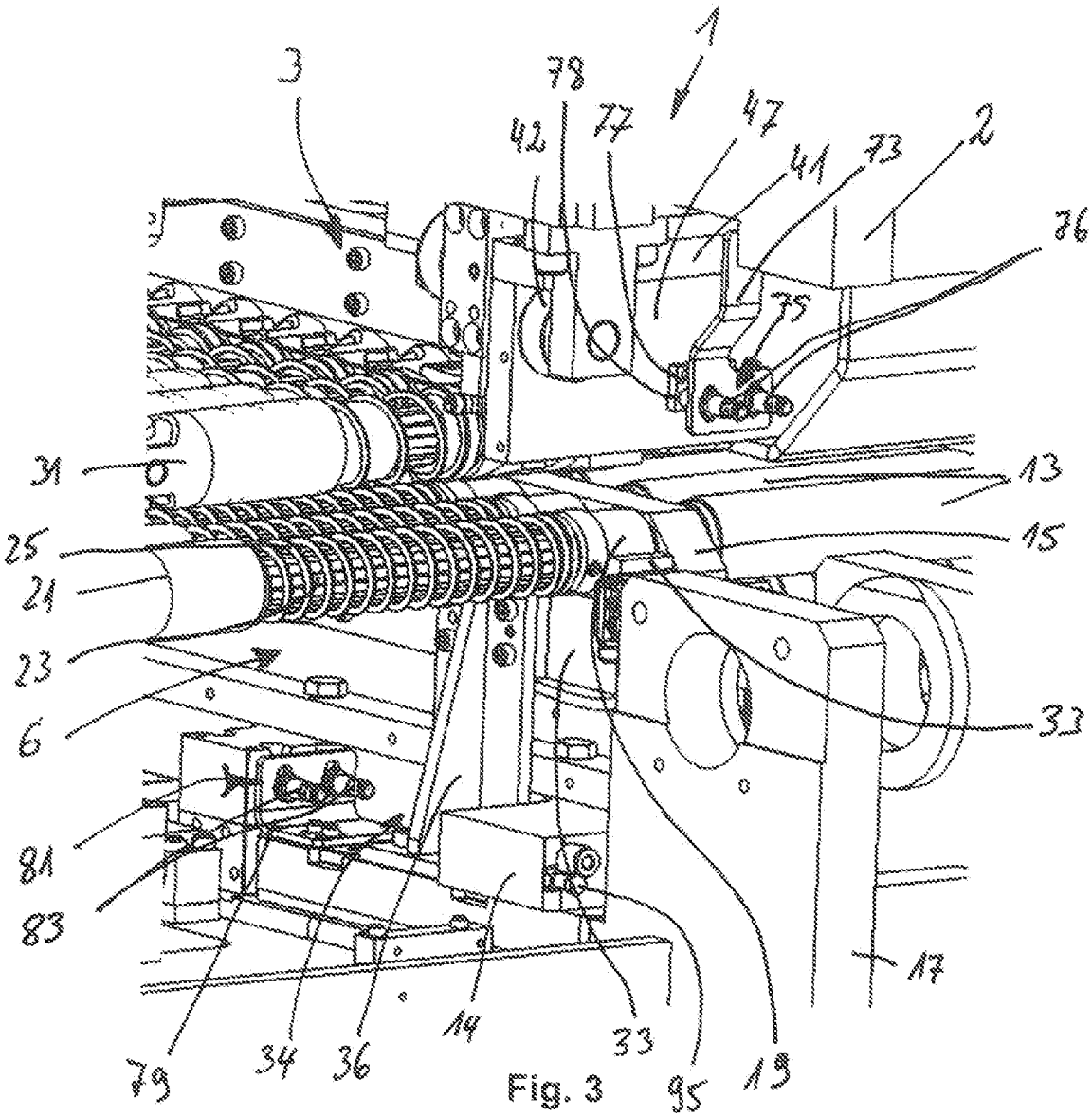
FIG. 3 shows an enlarged, perspective view similar to that of FIG. 2.

FIG. 3 shows a perspective view in even greater detail of a section of the rear area of roller leveler 1. Lower leveling rollers 13 are supported in the rear of lower bearing plate 15. Directly next to this is lower coupling bearing plate 33 which supports sleeve elements 19 of the coupling.

Figure 4:
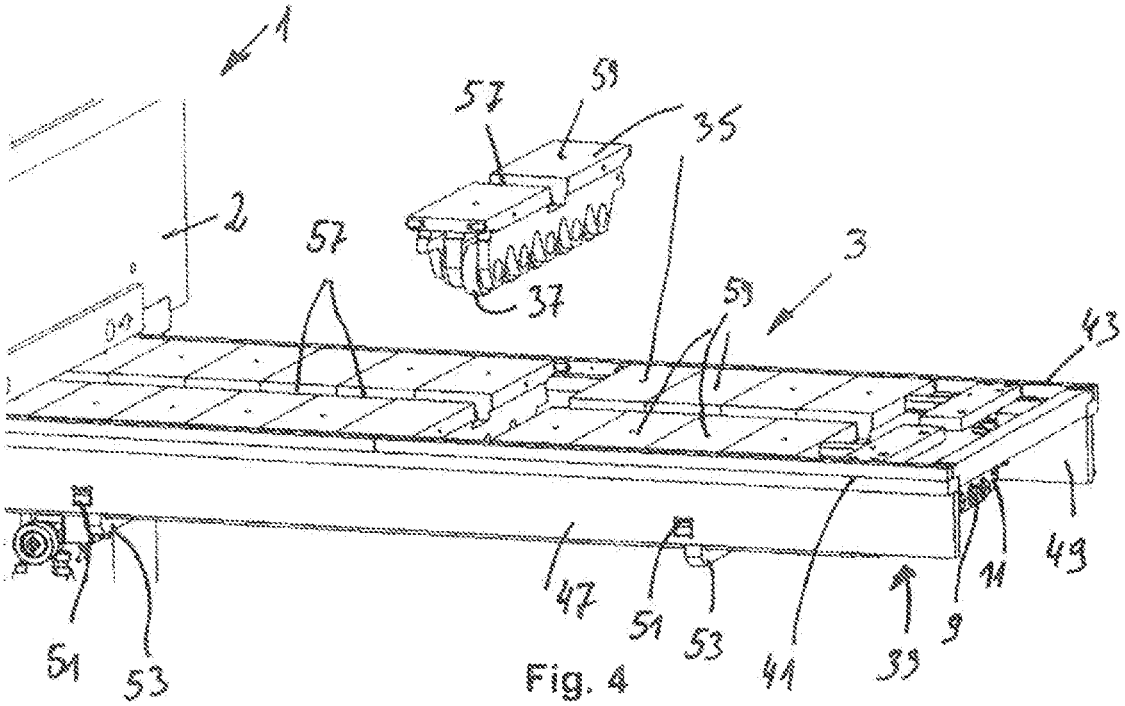
FIG. 4 shows a side view, in perspective, of the back-out upper leveling unit and of a back-up roller block which has been lifted from it.
Figure 5:
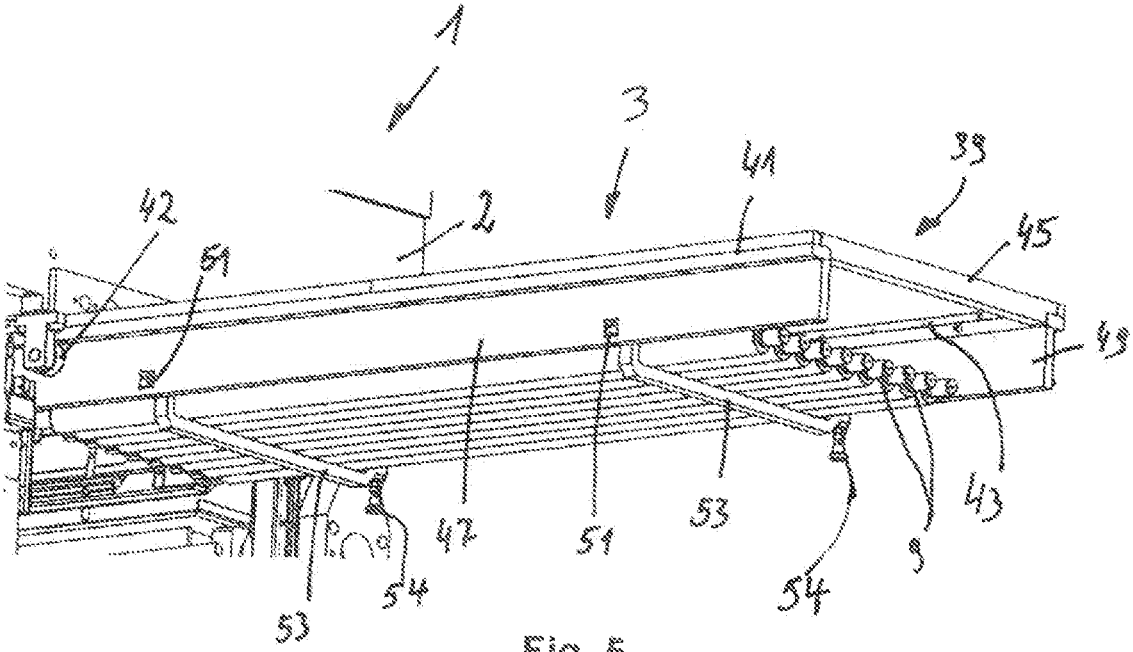
FIG. 5 shows a view of the backed-out upper leveling unit at an angle from below, after the removal of the back-up roller blocks and bearing plates.

As can be seen clearly in FIGS. 4 and 5, upper leveling unit 3 includes upper leveling rollers 9, upper bearing plates 11, upper back-up roller blocks 35 with upper back-up rollers 37, and a frame 39. Frame 39 has two longitudinal rails, i.e., a left longitudinal rail 41 and a right longitudinal rail 43. Longitudinal rails 41 and 43 are connected at their forward ends by a transverse strut 45 and at the opposite or rear-facing ends by another transverse strut (not shown in FIGS. 4 and 5). Underneath longitudinal rails 41 and 43 are board-like stiffened holders 47 and 49. In holder 47, openings 51 are formed, which serve to accept the installation of at least one retainer 53. Two retainers 53 are shown in the diagrams according to FIGS. 4 and 5. Openings 51 are formed in only one of two holders 47, and each retainer 53 is detachably screwed by a screw 54 to the other holder 49.

As is especially clear from FIG. 5, upper leveling rollers 9 are prevented from falling down by retainers 53. L-shaped longitudinal rails 41 and 43 are movably supported on rollers 42. Along upper roller assembly 2, a plurality of rollers 42 are provided on each longitudinal side of leveling unit 3. Front-most roller 22 and its supporting components are configured in correspondence with the load of the entire upper leveling unit 3 to be absorbed.

Figure 12:
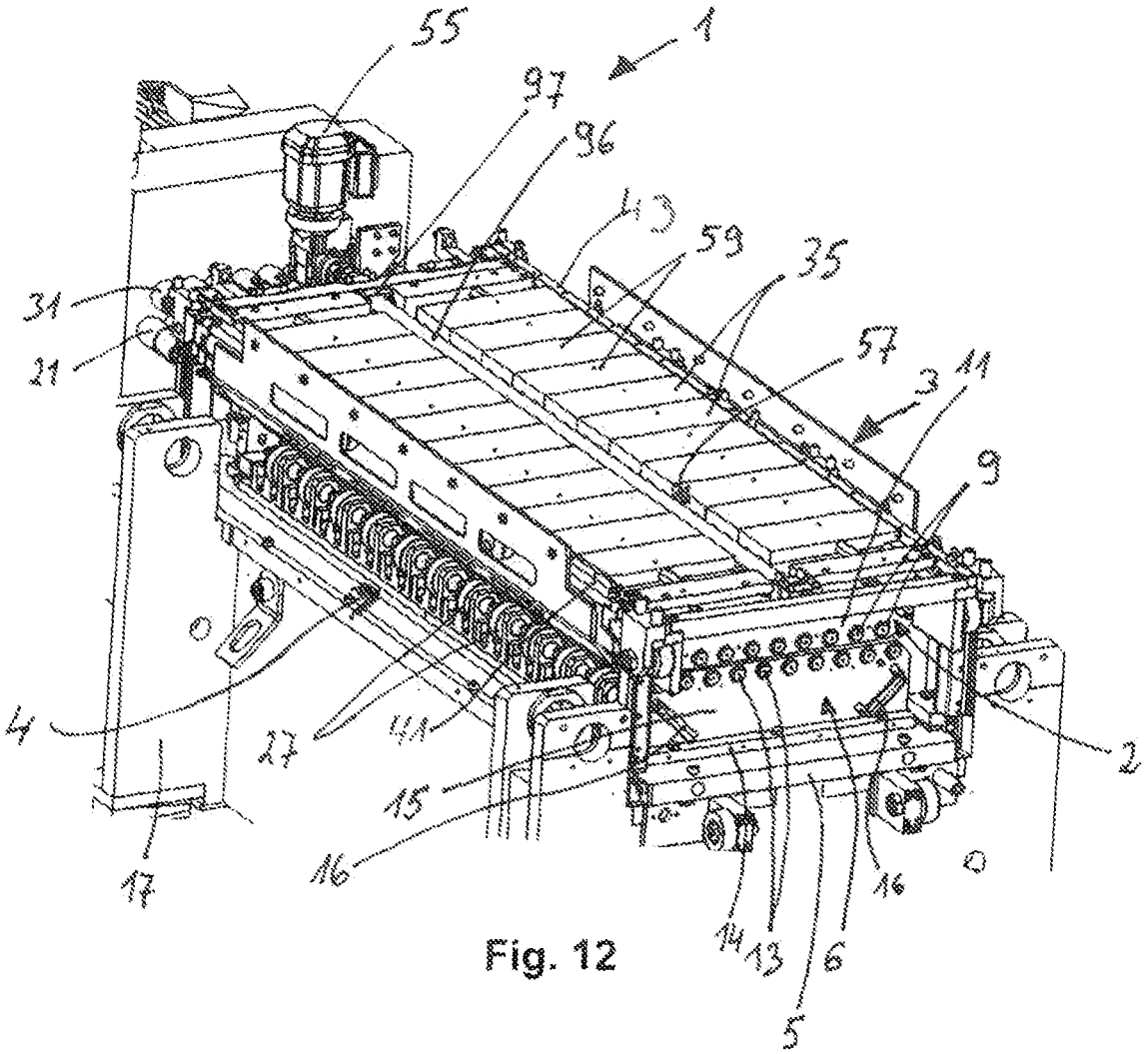
FIG. 12 shows a perspective view of an upper roller frame and a lower roller frame and a drive of a frame of an upper leveling unit.

In the following, the method according to the invention will be described. Upper leveling unit 3 is moved out of roller leveler 1. This is done by rotating a spindle 96 (FIG. 12) by a drive motor 55 (FIGS. 2 and 12). The spindle is mounted in leveling machine 1 without freedom to shift longitudinally and engages in a nut 97 (FIG. 12), which is arranged on the rear transverse strut of frame 39. In the fully installed state of upper leveling unit 3, the rotary spindle 96 (FIG. 12) is located in a groove 57, which is formed in each of upper back-up roller blocks 35 (FIG. 4).

After upper leveling unit 3 has been moved out, upper front bearing plate 11 is released from its fastening by loosening the clamping screws, for example, only a small shift is sufficient to allow the entire fixation of back-up roller blocks 35, which for their own part are supported in a floating manner on longitudinal rails 41 and 43, to be removed.

FIG. 4 shows in schematic fashion the removal of one of back-up roller blocks 35. Openings 59 are introduced into the top surface of back-up roller blocks 35; these openings serve to accept anchors in the form of lugs, for example, which can be connected to the hooks of lifting devices such as gantry cranes. Thus, back-up roller blocks 35 can be easily and conveniently lifted out of upper leveling unit 4; forward bearing plate 11 can also be lifted out. This state is illustrated in FIG. 5. Upper leveling rollers 9 released from bearing plate 11 are now resting on retainers 53 and can be either pulled out from upper leveling unit 3 slightly toward the front or lifted upward, as can be easily derived from FIG. 5. Upper leveling unit 3 is reinstalled by the corresponding reversal of this sequence of steps.

Alternatively, back-up roller blocks 35 can be lifted out and replaced not just individually but also in groups. This can be accomplished alternatively by appropriately configured magnets or by a suction device operating with negative pressure. Because individual upper back-up roller blocks 35 are not fastened to frame 39, the removal and replacement can be achieved in a correspondingly easy and rapid manner without the need for any additional unfastening and refastening measures.

Figure 6:
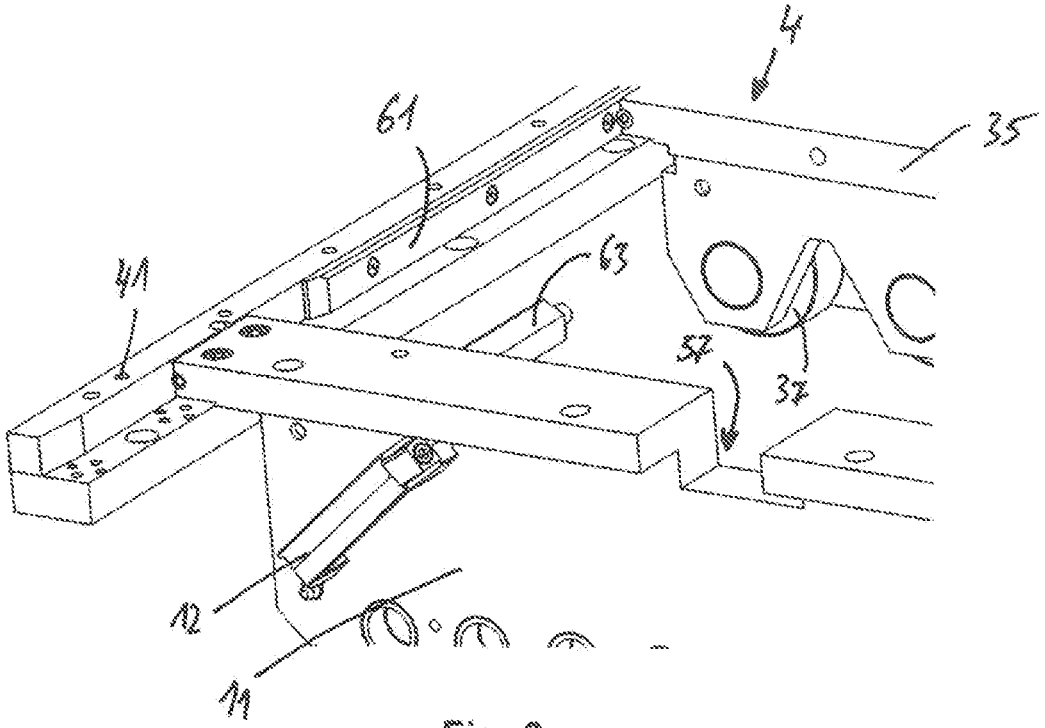
FIG. 6 shows a side view, in perspective, of the backed-out upper leveling unit and a left section of the frame.
Figure 7:
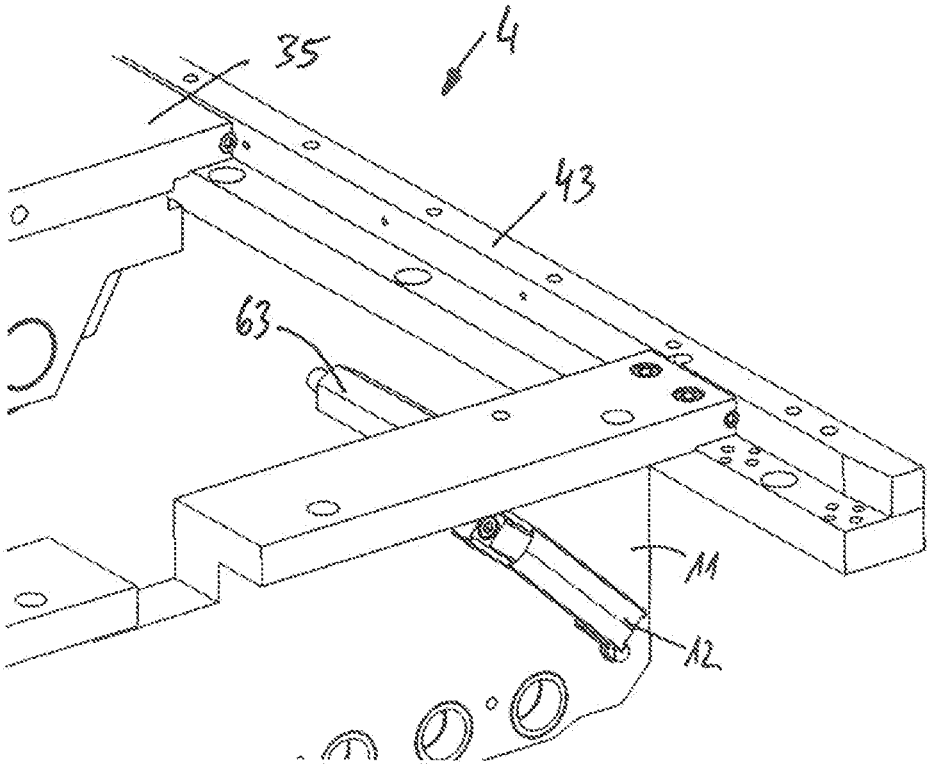
FIG. 7 shows a perspective view of the backed-out upper leveling unit with a right section of the frame.

FIG. 6 shows a purely schematic, perspective diagram of a section of left longitudinal rail 41. (Holder 47 is not shown.) So that back-up roller blocks 35 are always inserted in the correct order relative to upper leveling rollers 9, an additional rail 61 is attached to left longitudinal rail 41; as can be seen in FIG. 7, this additional rail is not present on right longitudinal rail 43. The additional rail is preferably made of a slightly elastic material such as silicone or a suitable plastic.

Spacers 63, by which a predetermined distance can be set between the front-most back-up roller block and upper bearing plate 11, are provided on upper bearing plate 11 and extend toward back-up roller blocks 35. Spacers 63 can be of different lengths, as a result of which a displacement of the back-up roller blocks can be achieved, as described in European patent EP2,631,019 B1 of the applicant.

Returning now to FIG. 3, the automatic detection of the movement of upper leveling unit 3 will now be described. An inductive sensor device 75 with two sensor heads 76 which are arranged opposite a small plate 77 are provided on a bracket 73 of upper roller assembly 2. Sensor device 75 serves to detect the inward movement of upper leveling unit 3. As soon as sensor device 75 detects the rear edge 78 of small plate 77, the inward-moving speed of upper leveling unit 3 is reduced, and the drive device of upper drive shafts 31 starts to turn the shafts slowly, so that the projecting neck elements of upper leveling rollers 9 can fit properly into sleeve elements 19. As soon as the front edge of small plate 77 is detected, the inward movement of upper leveling unit 3 is stopped.

The drive of lower leveling unit 6 proceeds in a manner similar to that used for upper leveling unit 3. A drive motor 56 drives a nonshiftable drive spindle, which is arranged underneath mounting plate 14. Due to drive motor 56, the drive spindle rotates in a nut, which is connected to mounting plate 14, as a result of which mounting plate 14 and thus, lower leveling unit 6 are moved in the longitudinal direction.

To detect the inward movement of lower leveling unit 6, an inductive sensor device 81 with two sensor heads 83 is arranged on a bracket 79, and a small plate is arranged on the inside surface of recess 34 in mounting plate 14. Similar to sensor device 75 for upper leveling unit 3, the speed of the inward movement is decreased upon detection of the rear edge of the small plate, and lower drive shafts 21 start to turn slowly to initiate the process by which the shafts are coupled to lower leveling rollers 15.

Figure 8:
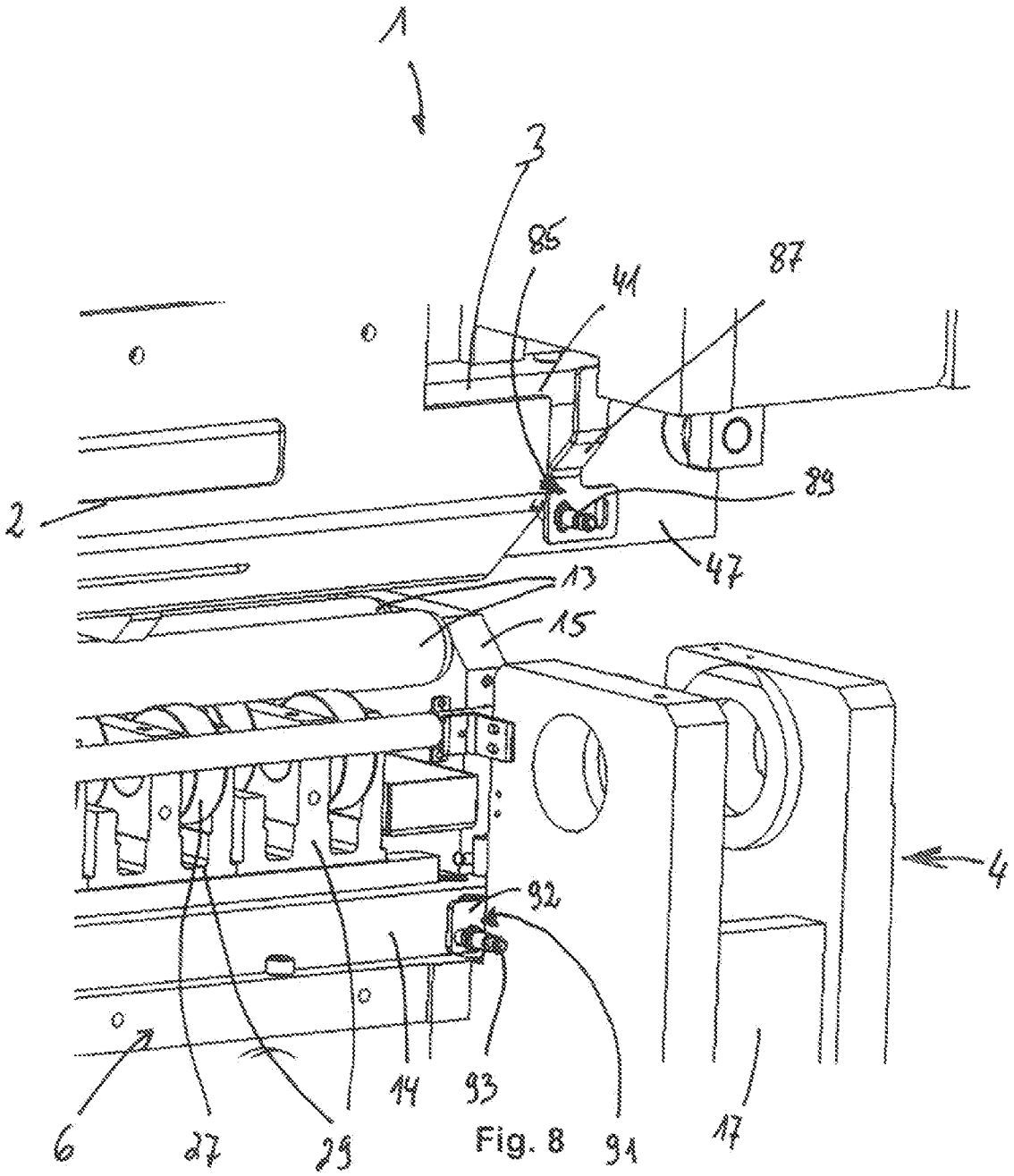
FIG. 8 shows a side view, in perspective, of the feed side of the leveling machine.

FIG. 8 shows a perspective view of the side of roller leveler 1 according to the invention to which the stock to be leveled is fed. In the position shown in FIG. 8, upper and lower leveling units 3, 6 are in the operating position of the leveling machine; i.e., they are in the fully installed position. An inductive sensor device 85, which is attached to a bracket 87 on upper roller assembly 2, has a sensor head 89. When upper leveling unit 2 moves outward, sensor device 85 detects small plate 77 and stops the outward movement of upper leveling unit 2.

The outward movement of lower leveling unit 6 is monitored in a similar manner. An inductive sensor device 91, which is attached to a bracket 92 on lower roller assembly 4, includes a sensor head 93. This detects a sensor screw 95 (FIG. 3) and stops the outward movement of lower leveling unit 6 when this screw reaches the sensor head.

The use of sensor devices 85, 91, 75, and 81 make it possible to monitor advantageously the automatic inward and outward movement of both upper and lower leveling units 3, 6.

FIG. 9 shows upper universal shafts 31, which drive upper leveling rollers 9, and lower drive shafts 21, which drive lower leveling rollers 13. One can clearly see polygonal profile 23, which is formed on both lower drive shafts 21 and on upper universal shafts 31. The upper universal shafts include a joint 22 assigned to upper leveling rollers 9 and a joint 24 assigned to the drive side. Joint 22 assigned to upper leveling rollers 9 includes a sleeve element 20, which has a polygonal interior recess, especially an inside hexagonal recess, like that of sleeve element 19. This polygonal recess serves to engage with a neck-like projection with a corresponding external profile on the associated end of upper leveling roller 9. Sleeve element 20 is supported with freedom to rotate and to shift longitudinally in an upper coupling bearing plate 32, which can be seen even more clearly in FIG. 10.

Joint 22 includes a rear, sleeve-shaped joint element 28, which has an internal recess cooperating with external polygonal profile 23 of universal shaft 31 on which it can shift longitudinally. As can be clearly seen in FIG. 9, a helical spring 26 presses joint 22 and thus, sleeve element 20 against upper leveling roller 9; the spring-loaded contact of sleeve element 20 creates the coupling connection with upper leveling roller 9 in question.

As can be derived from FIG. 10, sleeve elements 20 are supported with freedom of longitudinal movement in upper coupling bearing plate 32, which for its own part is permanently connected to upper leveling unit 3 of the leveling machine. As also in the case of lower leveling unit 6, when upper leveling unit 3 moves inward, the neck-like projections of upper leveling rollers 9, which include the polygonal internal profile, e.g., a hexagonal profile, meet sleeve elements 20, which have corresponding internal hexagonal recesses. The two profiles may not be aligned immediately; rather, insofar as the profiles are offset from each other, inwardly moving leveling rollers 9 press sleeve elements 20 toward the rear along polygonal profile 23 against the force of helical springs 26.

Upper leveling unit 3, like lower leveling unit 6, can be moved completely in, and then the coupling process can be carried out independently thereafter; or sleeve elements 20 can be rotated, first in one direction and then in the other, for example, by universal shafts 31 as soon as the ends of the leveling rollers make contact with sleeve elements 20; the back-and-forth rotation continues until the angles of the two profiles line up, at which point sleeve element 20, because of the pretension created by helical spring 26, snaps onto the external profile, i.e., the neck-like projection, of upper leveling roller 9. In this way, upper universal shaft 31 and associated upper leveling roller 9 are coupled together.

Figure 11:
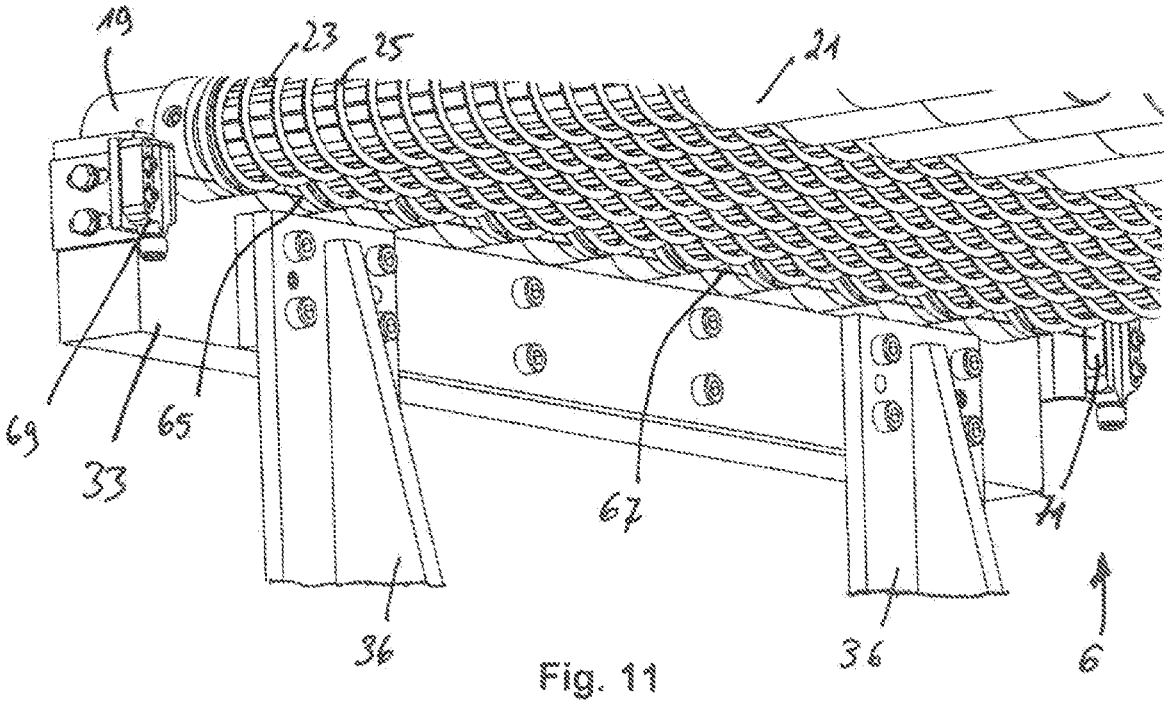
FIG. 11 shows a schematic diagram, in perspective and at an angle from below, of the drive shafts and coupling elements of the lower leveling unit.

Oftentimes, the location in which the coupling occurs is very difficult to see, as explained above, so that it is only with difficulty that one can determine externally whether or not associated upper and lower leveling rollers 9 and 13 have been effectively connected to their associated upper and lower drive shafts 31, 21, and because it is also desirable to increase the degree of automation of the operation of roller leveler 1 according to the invention, sleeve elements 19 and 20, as can be seen in FIGS. 9-11, include a circumferential groove 65, and a light beam 67 is sent out from a light beam source 69.

If all of sleeve elements 20 and upper leveling rollers 9 have been successfully coupled, circumferential grooves 65 are aligned, and light beam 67 sent by the light beam source 69 strikes a light beam receiving device 71. The arrival of light beam 67 thus makes it possible to determine that there is an effective connection between upper universal shafts 31 and the upper leveling rollers, and leveling machine 1 can be put into operation.

FIG. 11 shows the coupling mechanism of lower leveling unit 6, which is configured in a manner similar to that of the upper coupling mechanism. Accordingly, sleeve elements 19 include circumferential grooves 65, through which a light beam 67 can be sent from light beam source 69 to light beam receiving device 71, as a result of which it can be concluded that all of lower leveling rollers 13 have also been successfully coupled to associated sleeve elements 19.

FIG. 12 shows a perspective view of the upper roller frame 2 and the lower roller frame 4. Said upper roller frame 2 including the upper leveling unit 3 which comprises frame 39. The frame 39 of the upper leveling unit 3 is driven by a drive comprising a motor, preferably by an electric motor 55, said drive comprising a nonshiftable drive spindle 96 cooperating with a nut 97 which is fixed to the frame 39. Turning of the drive spindle 96 by drive motor 55 in one direction moves the frame 39 in one direction and turning the drive spindle 96 in the other direction moves the frame 39 in the opposite direction.

The present invention is not limited to the exemplary embodiments presented here. Instead of mounting plate 14, it is also possible, for example, for lower leveling unit 6 to include a frame, on which the lower back-up roller blocks are supported in floating fashion.

It is also possible to use some other type of distance-detection sensor which is able to detect the movement of the upper and lower leveling units, as a result of which the machine control system can also be advantageously enabled to control automatically the outward and inward movement of upper and lower leveling units 3, 6, this being especially advantageous because the process by which upper and lower leveling rollers 9, 13 are coupled to upper and lower drive shafts 31, 21 is also automated.

The present invention is an advantageous roller leveler which makes it possible to inspect, maintain, service, and clean the upper leveling rollers of a roller leveling machine in a simple, rapid, and ergonomic manner. The method according to the invention also provides additional significant advantages.

8 right cover section
9 upper leveling rollers
11 upper bearing plates
12 loop-like handles
13 lower leveling rollers
14 mounting plate
15 lower bearing plates
16 loop-like handles
17 mounting frame of the hydraulic cylinder
18 distance-measuring system
19 sleeve element
20 forward sleeve-like joint element: sleeve element
21 lower drive shaft
22 joint assigned to the leveling rollers
23 polygonal profile
24 joint assigned to the drive side
25 helical spring
26 helical spring
27 lower back-up rollers
28 rear sleeve-like joint element
29 lower back-up roller blocks
31 upper universal shafts
32 upper coupling bearing plate
33 lower coupling bearing plate
34 recess
35 upper back-up roller blocks
36 brace
37 upper back-up rollers
39 frame
41 left longitudinal rail
42 roller
43 right longitudinal rail
45 transverse strut
47 board-like stiffened holder
49 board-like stiffened holder
51 opening
53 retainer
55 drive motor
56 drive motor
57 groove
59 opening
61 additional rail
63 spacer
65 peripheral groove
67 light beam
69 light beam source
71 light beam receiving device
73 bracket
75 inductive sensor device
76 sensor heads
77 small plate
78 rear edge
79 bracket
81 inductive sensor device
83 sensor heads
85 inductive sensor device
87 bracket
89 sensor head
91 inductive sensor device
92 bracket
93 sensor head
95 detection screw

The invention claimed is:

1. A roller leveler for leveling stock to be leveled, comprising: an upper roller support structure, on which an upper leveling unit is arranged; and a lower roller support structure having a machine bed, on which a lower leveling unit is arranged; wherein the upper roller support structure is moveable upward and downward relative to the lower roller support structure by a plurality of drives, and the upper leveling unit comprises a plurality of upper leveling rollers and the lower leveling unit comprises a plurality of lower leveling rollers; wherein the upper leveling rollers are supported at both ends in upper bearing plates and the lower leveling rollers are supported at both ends in lower bearing plates, and at least several of the upper and lower leveling rollers are connected at one end to drive shafts of a drive device and have a plurality of upper and lower back-up rollers which serve to support the upper and lower leveling rollers, the upper and lower back-up rollers are supported in a plurality of upper back-up roller blocks and lower back-up roller blocks, the upper leveling unit having a frame on which the bearing plates of the upper leveling rollers and the upper back-up roller blocks are supported, said frame for inspection, maintenance and servicing of the upper leveling unit being moveable out of the roller leveler and back into the roller leveler, wherein said frame being always held by the upper roller support structure, the upper roller support structure remaining in the roller leveler during this moveable action, the upper leveling unit and the lower leveling unit being independently moveable.

2. The leveling machine of claim 1 wherein the frame of the upper leveling unit comprises at least two longitudinal rails which are connected to each other at both ends by transverse struts.

3. The leveling machine of claim 1 wherein the movement of the frame of the upper leveling unit is achieved by a drive, which drives a drive spindle, which engages with a nut connected to the frame.

4. The leveling machine of claim 3 wherein the drive is an electric motor.

5. The leveling machine of claim 1 further including a positive, releasable coupling being provided, formed out of a sleeve element arranged on the associated drive shaft of the leveling rollers and a projecting neck element on the associated leveling roller, wherein the sleeve elements of the lower drive shafts are supported in a lower coupling bearing plate, and the sleeve elements of the upper drive shafts are supported in an upper coupling bearing plate.

6. The leveling machine of claim 5 wherein the leveling rollers are released from their connections by moving the frame of the upper leveling unit of the leveling machine.

7. The leveling machine of claim 5 wherein the sleeve element comprises a groove, through which a beam from a source can be conducted transversely to the axes of the leveling rollers to a receiving device, wherein, by the detection of the light beam by the receiving device, it is determined that an effective coupling exists between the leveling rollers and the drive shafts.

8. The leveling machine of claim 7 wherein the beam is a light beam.

9. The leveling machine of claim 1 wherein the upper back-up roller blocks are supported on the frame of the upper leveling unit in floating fashion.

10. The leveling machine of claim 1 wherein a connecting device, an individual upper back-up roller block or simultaneously a plurality of upper back-up roller blocks can be lifted out and set back in again, wherein the connecting device can be configured as an anchor which can be inserted into the upper back-up roller block, a magnet, or a suction device operating with negative pressure.

11. A method for inspection, maintenance, and servicing, including cleaning, of the upper leveling rollers of a roller leveler machine for leveling stock to be leveled, the method comprising:

(a) providing an upper roller support structure on which an upper leveling unit is arranged and a lower roller support structure, which comprises a machine bed, on which a lower leveling unit is arranged, wherein the upper roller support structure can be moved upward and downward relative to the lower roller support structure by a plurality of drives, wherein the upper leveling unit comprises a plurality of upper leveling rollers and the lower leveling unit comprises a plurality of lower leveling rollers, wherein the upper leveling rollers are supported at both ends in upper bearing plates and the lower leveling rollers are supported at both ends in lower bearing plates, and at least several of the upper and lower leveling rollers are connected at their ends to drive shafts of a drive device, wherein said roller leveler machine comprises a plurality of upper and lower back-up rollers, which serve to support the upper and lower leveling rollers, wherein the upper and lower back-up rollers for their own part are supported in a plurality of upper back-up roller blocks and lower back-up roller blocks, wherein the upper leveling unit comprises a frame, on which the bearing plates of the upper leveling rollers and the upper back-up roller blocks are supported, and wherein the frame can be moved out of the roller leveler machine and back into the roller leveler, wherein said frame being always held by the upper roller support structure, the upper roller support structure remaining in the roller leveler during this moveable action, the upper leveling unit and the lower leveling unit being independently moveable;

(b) moving the upper leveling unit out of the leveling machine;

(c) disconnecting the fastening of the forward bearing plate;

(d) connecting one or more of the upper back-up roller blocks to be lifted out to a lifting device;

(e) lifting out the one or more of the upper back-up roller blocks from the frame and possibly setting it or them down onto a suitable support surface;

(f) in case that more upper back-up roller blocks have to be lifted out to a lifting device than in first step (d) repeating step (d);

(g) inspecting the upper leveling rollers from above and possibly cleaning and replacing leveling rollers;

(h) replacing the upper back-up roller blocks;

(i) fastening the forward bearing plate; and (j) moving the upper leveling unit back into the leveling machine and coupling the leveling rollers to their drive device.

12. The method of claim 11 wherein the positive polygonal profiles of the ends of the upper and lower leveling rollers are coupled to positive profiles of coupling elements of the drive devices of the upper and lower leveling rollers in step (i) in that the coupling elements are rotated simultaneously under pressure until the ends of the leveling rollers and the coupling elements are engaged.

13. The method of claim 12 wherein a light barrier verifies that all of the leveling rollers are properly coupled.

14. The method of claim 11 wherein that before the removal of individual upper leveling rollers, at least one retainer is placed under the upper leveling rollers.

15. The method of claim 11 wherein in order to connect an individual upper back-up roller block, at least one connecting device is provided, by which an individual upper back-up roller block, or simultaneously a plurality of upper back-up roller blocks, can be lifted out and set back down again, wherein the connecting device can be configured as an anchor which can be inserted into the upper back-up roller block, a magnet, or a suction device operating with negative pressure.

16. The method of claim 11 said plurality of drives are hydraulic drives.

* * * * *